US007344491B1

(12) United States Patent
Seeney et al.

(10) Patent No.: US 7,344,491 B1
(45) Date of Patent: Mar. 18, 2008

(54) METHOD AND APPARATUS FOR IMPROVING HEARING

(75) Inventors: Charles E. Seeney, Edmond, OK (US); Kenneth J. Dormer, Edmond, OK (US)

(73) Assignee: Nanobiomagnetics, Inc., Edmond, OK (US)

( * ) Notice: Subject to any disclaimer, the term of this patent is extended or adjusted under 35 U.S.C. 154(b) by 286 days.

(21) Appl. No.: 10/965,056

(22) Filed: Oct. 14, 2004

Related U.S. Application Data

(63) Continuation-in-part of application No. 10/724,563, filed on Nov. 26, 2003, now abandoned.

(51) Int. Cl.
*H04R 25/00* (2006.01)

(52) U.S. Cl. ..... 600/25

(58) Field of Classification Search ..... 600/9–15, 600/25; 128/746, 897–899; 623/10, 24; 381/23.1, 312; 181/126, 129–130; 607/55–57; 977/902, 904

See application file for complete search history.

(56) References Cited

U.S. PATENT DOCUMENTS

| | | | | |
|---|---|---|---|---|
| 4,356,029 | A | 10/1982 | Down et al. | 75/0.5 |
| 4,376,740 | A | 3/1983 | Uda et al. | 264/10 |
| 4,466,896 | A | 8/1984 | Darden | 252/78.3 |
| 4,501,726 | A | 2/1985 | Schroder et al. | 424/1.1 |
| 4,526,922 | A | 7/1985 | Pickwell et al. | 524/445 |
| 4,652,257 | A | 3/1987 | Chang | 604/52 |
| 4,687,511 | A | 8/1987 | Paliwal et al. | 75/0.5 |
| 4,690,130 | A | 9/1987 | Mirell | 128/1.3 |
| 5,069,936 | A | 12/1991 | Yen | 427/213.33 |
| 5,069,971 | A | 12/1991 | Waketa et al. | 428/391 |
| 5,160,725 | A | 11/1992 | Pilgrimm | 424/9 |
| 5,349,957 | A | 9/1994 | Yudelson | 128/653 |
| 5,427,767 | A | 6/1995 | Kresse et al. | 424/9.32 |
| 5,512,474 | A | 4/1996 | Clapper et al. | 435/240 |
| 5,549,915 | A | 8/1996 | Volkonsky et al. | 424/490 |
| 5,578,325 | A | 11/1996 | Domb et al. | 424/501 |
| 5,651,989 | A | 7/1997 | Volkonsky et al. | 424/490 |
| 5,695,901 | A | 12/1997 | Selim | 430/106.2 |
| 5,705,195 | A | 1/1998 | Volkonsky et al. | 424/490 |

(Continued)

FOREIGN PATENT DOCUMENTS

DE 4309333 9/1994

(Continued)

OTHER PUBLICATIONS

Panyam et al., "Biodegradable nanoparticles for drug and gene delivery to cells and tissue", article, Sep. 16, 2002, Department of Pharmaceutical Sciences, pp. 329-347.*

(Continued)

*Primary Examiner*—Samuel G. Gilbert
(74) *Attorney, Agent, or Firm*—Dunlap Codding & Rogers

(57) ABSTRACT

A system and method for affecting the function of a mammalian ear. The system and method uses an oscillating magnetic field to move nanospheres comprised of single-domain nanoparticles. In a preferred embodiment a receiving assembly detects sound waves and transmits the sound waves to a processor. The processor drives an electromagnetic coil in response to the detected sound waves. The electromagnetic coil transmits a signal that causes vibration of the nanoparticles and the tissues within which the nanoparticles are implanted.

11 Claims, 4 Drawing Sheets

U.S. PATENT DOCUMENTS

| | | | | |
|---|---|---|---|---|
| 5,711,803 | A | 1/1998 | Pehnt et al. | 117/4 |
| 5,788,738 | A | 8/1998 | Pirzada et al. | 75/331 |
| 5,851,507 | A | 12/1998 | Pirzada et al. | 423/659 |
| 5,876,683 | A | 3/1999 | Glumac et al. | 423/325 |
| 5,916,539 | A | 6/1999 | Pilgrimm | 424/9.322 |
| 5,928,958 | A | 7/1999 | Pilgrimm | 436/526 |
| 5,984,997 | A | 11/1999 | Bickmore et al. | 75/343 |
| 6,004,786 | A | 12/1999 | Yamashita et al. | 435/176 |
| 6,007,845 | A | 12/1999 | Domb et al. | 424/501 |
| 6,048,515 | A | 4/2000 | Kresse et al. | 424/9.322 |
| 6,123,920 | A | 9/2000 | Gunther et al. | 424/9.322 |
| 6,153,172 | A | 11/2000 | Schroder | 424/9.322 |
| 6,200,547 | B1 | 3/2001 | Volkonsky et al. | 424/9.36 |
| 6,203,777 | B1 | 3/2001 | Schroder | 424/9.322 |
| 6,207,195 | B1 | 3/2001 | Walsh et al. | 424/489 |
| 6,254,940 | B1 | 7/2001 | Pratsinis et al. | 427/562 |
| 6,274,121 | B1 | 8/2001 | Pilgrimm | 424/9.42 |
| 6,344,357 | B1 | 2/2002 | Rickwood | 435/455 |
| 6,409,925 | B1 | 6/2002 | Gombinsky et al. | 210/695 |
| 6,436,028 | B1 * | 8/2002 | Dormer | 600/25 |
| RE37,853 | E | 9/2002 | Detering et al. | 75/10.19 |
| 6,472,632 | B1 | 10/2002 | Peterson et al. | 219/121.59 |
| 6,482,436 | B1 | 11/2002 | Volkonsky et al. | 424/489 |
| 6,514,481 | B1 | 2/2003 | Prasad et al. | 424/9.32 |
| 6,548,264 | B1 * | 4/2003 | Tan et al. | 435/7.21 |
| 6,620,627 | B1 | 9/2003 | Liberti et al. | 436/526 |
| 6,763,607 | B2 | 7/2004 | Beyerinck et al. | 34/372 |
| 6,767,637 | B2 | 7/2004 | Park et al. | 428/402.21 |
| 6,884,817 | B2 | 4/2005 | Li et al. | 514/449 |
| 7,169,618 | B2 | 1/2007 | Skold | 436/526 |
| 2001/0039919 | A1 | 11/2001 | Hunt et al. | 118/300 |
| 2002/0046993 | A1 | 4/2002 | Peterson et al. | 219/121.59 |
| 2002/0053557 | A1 | 5/2002 | Peterson et al. | 219/121.43 |
| 2002/0086842 | A1 | 7/2002 | Plank et al. | 514/44 |
| 2002/0155059 | A1 | 10/2002 | Boulos et al. | 423/613 |
| 2002/0160190 | A1 | 10/2002 | Yadav et al. | 428/402 |
| 2004/0133099 | A1 | 7/2004 | Dyer et al. | |

FOREIGN PATENT DOCUMENTS

| | | | |
|---|---|---|---|
| WO | WO 98/01160 | | 1/1998 |
| WO | WO 99/60998 | | 12/1999 |
| WO | WO 02/056890 | A1 | 7/2002 |
| WO | WO 03/059194 | A2 | 7/2003 |
| WO | WO 2004006765 | | 1/2004 |

OTHER PUBLICATIONS

Fadee Mondalek, "Concerns Regarding the Permeability of the Round Window Membrane (RWM) to Magnetic Nanoparticles Attached to a Drug/Gene", article, Oct. 28, 2003, OU Health Sciences Center, Oklahoma City, Oklahoma.*

Rene Massart, "Preparation of Aqueous Magnetic Liquids in Alkaline and Acidic Media", article, IEEETransactions On Magnetics, Mar. 1981, pp. 1247-1248, vol. Mag-17, No. 2.

Young Zhang et al., "Surface modificationof superparamagnetic magnetite nanoparticles...", article, Aug. 8, 2001, Dept of Materials Science & Engineering, pp. 1553-1561.

Jayanth Panyam, et al., "rapid endo-lysomal escape of poly(DL-lactide-co-glycolide) nanoparticles...", article, Apr. 18, 2002, Dept Pharm Sci, vol. 17, pp. 1217-26.

Swayam Prabha, et al., "Size-dependency of nanoparticle-mediated gene transfection...", article, Jun. 6, 2002, Int J Pharm, vol. 224, pp. 105-115.

Chantal A. Lackey, et al., "A Biomimetic pH-Responsive Polymer Directs Endosomal Release...", Article, Jul. 25, 2002. Bio. Chem., vol. 13, No. 5, pp. 996-1001.

C. Wilhelm, et al., "Intracellular uptake of anionic superparamagnetic nanoparticles...", article, Sep. 9, 2002, Biomaterials vol. 24, pp., 1001-1011.

Jayanth Panyam, Vinod Labhasetwar, "Biodegradable nanoparticles for drug and gene...", article, Sep. 16, 2002, Department of Pharmaceutical Sciences, pp. 329-347.

"Electronic Publication by Bussiness Communications Company, Inc., " "Nanoparticle News", Oct. 2002.

Niren Murthy, et al., "Bioinspired ph-Responsive Polymers for...", article, Jan. 15, 2003, Dept of Bioengineering and Dept of Pathology, vol. 14, pp. 412-419.

Junghae Suh, et al., "Efficient active transport of gene nanocarriers", article, April 1, 2003, Dept of Biomed Eng..., Mol Biophysics Prog, John Hopkins Univ, Baltimore, MD.

Christian Plank, et al., "The Magnetoflection method: Using Magnetic Force to Enhance Gene Delivery", Journal, May 2003, vol. 384, pp.737-747.

Ge Liu, et al., "Nanoparticles of Compacted DNA Tranfect Postmitotic Cells", Journal, Jun. 14, 2003, vol. 278, No. 35, pp. 32578-32586.

A. Pankhurst, et al., "Applications of magnetic nanoparticles in biomedicine", Journal of Physics D; Applied Physics, Jun. 18, 2003, pp. R167-R181.

Pedro Tartaj, et al. "The preparation of magnetic nanoparticles for applications in biomedicine", Journal of Physics D: Applied Physics, Jun. 18, 2003, pp. R182-R197.

Catherine C. Berry and Adan S.G. Curtis, "Functionalisation of magnetic nanopaticles...", J Physics D: Applied Physics, jun. 18, 2003, pp. R198-R206.

X.X. He, et al., "A Novel Method... Amino-Modified Silica Coated Magnetic Nanoparticles", article, Jul. 27, 2003, State Key Laboratory of Chemo/Biosensing... , pp. 375-80.

Fadee Mondalek, "Concerns Regarding the ... to Magnetite Nanoparticale Atteched to a drug/Gene", article, Oct. 28, 2003, OU Health Sciences Center, Oklahoma City, Oklahoma.

Joseph F. Bringley and Nancy B. Liebert, "Controlled Chemical and drug Delivery...", J Dispersion Science and Tech, 2003, vol. 24, Nos. 3 & 4, pp. 589-605.

Rachael A. Jones, et al., "Poly(2-alkyacrylic acid) polhymers deliver molecules to ... endosomal vesicles", Journal, 2003. vol. 372, pp. 65-75.

N. Buske, C. Gansali, T. Rheinlander and B. Kroll, "Magnetic Sizing of Magnetic Nanoparticles",Mediport Kardiotechnik GmBH.

Bioelectromagnetics Society (BEMS) "Magnets Help Target Gene Therapy" Press Release, No date.

Utreja et al., "Lipoprotein-mimicking biovectorized systems for methotrexate delivery," Pharmaceutica ACTA Helvetia, No. 73 (1999) pp. 275-279 (Abstract XP-002383903).

Shutt et al., "Biocompatible Magnetic Polymer Carriers for In Vitro Radionuclide Delivery,"INT SOC for Artificial Organs, vol. 23, No. 1 (1999) pp. 98-103.

Nicoli et al., "Design of Triptorelin loaded nanospheres for transdermal iontophoretic administration, "INT Journal of Pharmaceutics, No. 214 (2001) pp. 31-35.

Brigger et al., "Nanoparticles in Cancer Therapy and Diagnosis, " Advanced Drug Delivery Reviews, vol. 54, (2002) pp. 631-651, Elsevier.

Duclairor et al., "Alpha-Tocopherol encapsulation and in vitro release from wheat gliadin nanoparticles," J. Microencapsulation, vol. 19 (2002), No. 1, pp. 53-60.

Chang, "Adriamycin-loaded immunological magnetic nanoparticles: Site-specific targeting...," Chinese Journal of Biomedical Eng. vol. 15, No. 4 (1996) pp. 354-359.

Christian Plank, et al., "The Magnetoflection method: Using Magnetic Force to Enhance Gene Delivery," Journal, May 2003, vol. 384, pp. 737-747.

Barbric, "Single Domain Magnets in Bio-Medical Applications," European Cells and Materials, vol. 3, Suppl. 2, 2002 (132-134).

Mornet et al, "Maghemite@silica nanoparticles for biological applications," European Cells and Materials, vol. 3, suppl 2, 2002 (110-113).

Jim Klostergaard, et al., "Magnetic Vectoring of Magnetically ... within the Murine Peritoneum," J of Magnetism and Magnetic Materials, vol. 311, Apr. 2007, pp. 330-335.

Correa-Duarte, et al., "Control of Packing Order of Self-Assembled Monolayers of Magnetite Nanoparticales with and without SiO2 ..." Langmuir, 1988, vol. 14, pp. 6430-6435.
Kirston Mason, "Targeted drug delivery achieved with nanoparticle-aptamer bioconjugates," Medical News Today, Nov. 6, 2005, available at www.medicalnewstoday.com.
Omid C. Farokhzad, et al., "Nanoparticle-Aptamer Bioconjugates, A New Approach for Targeting ..." Cancer Research 64, 7668-7672, Nov. 1, 2004.
Thornton, et al., "Magnetic Assisted Navigation in Electrophysiology and Cardiac Resynchronisation: A Review," Indian Pacing and Electrophys. J. 6(4): 202-213 (2006).
G.F. Goyya et al., "Static and dynamic magnetic properties of spherical magnetite nanoparticles," J. Applied Phisics, vol. 94, No. 5, Sep. 1, 2003, pp. 3520-3528.
"Domain Theory," unknown author, available from Institute for Rock Magnetism, Univ of Minnesota, at www.irm.edu/hg2m/hg2m_d/hg2m_d.html last visited Jul. 2007.
"The Basics of Silane Chimistry," available at www.dowcorning.com/content/publishedlit/SILANE-GUIDE.pdf.

* cited by examiner

METHOD AND APPARATUS FOR IMPROVING HEARING

CROSS REFERENCE TO RELATED APPLICATIONS

This application is a continuation-in-part of U.S. patent application Ser. No. 10/724,563, filed Nov. 26, 2003 now abandoned.

FIELD OF THE INVENTION

The present invention relates generally to a method and system for affecting the function of an ear, and more particularly, to the use of nanospheres having single-domain magnetically responsive nanoparticles to amplify sound received by the ear.

SUMMARY OF THE INVENTION

The present invention is directed to a method for affecting a function of a mammalian ear. The method comprises supporting at least a single-domain magnetically responsive nanoparticle in the ear of the mammal and transmitting a magnetic field to move the nanoparticle.

The invention further includes a system for affecting a function of a mammal. The system comprises a single-domain nanoparticle and a transmitter assembly. The nanoparticle is supported in a mammal ear. The transmitter assembly is supported on the mammal and transmits a magnetic field that causes movement of the nanoparticle. Movement of the nanoparticle affects the function of the mammal.

The present invention further includes a method for affecting function of a mammal. The method comprises supporting a magnetically responsive nanoparticle within the mammalian ear and transmitting a magnetic field to move the nanosphere.

Still yet, the present invention includes a system for affecting a function of a mammal ear. The system comprises a nanosphere having at least a single-domain nanoparticle and a transmitter assembly. The nanosphere is supported in the ear. The transmitter assembly is supported on the mammal and adapted to transmit a magnetic field that causes movement of the nanosphere.

Further still, the present invention is directed to a system for affecting a function of a mammal. The system comprises a single-domain nanoparticle and a transmitter assembly. The single-domain nanoparticle has a biocompatible covering and is supported in a mammal ear. The transmitter assembly transmits a magnetic signal that causes a movement of the nanoparticle.

BRIEF DESCRIPTION OF THE DRAWINGS

FIG. 6 is a diagrammatic representation of a system used to produce nanospheres containing single-domain superparamagnetic nanoparticles having uniformly aligned magnetic moments.

DESCRIPTION OF THE PREFERRED EMBODIMENT

Targeted delivery of therapeutics to a specific site within a body provides advantages over oral or systemic administration. For example, effective doses of therapeutics may be delivered at lower amounts to a desired target without exposing the entire body to adverse conditions or side effects. Drug delivery systems based on magnetically responsive nanoparticles provide a method for external control and site-specific delivery of therapeutics.

The present invention is directed to processes and methods for making nanospheres comprising single-domain nanoparticles. Further, the present invention is directed to the structure of nanospheres comprised of magnetically responsive nanoparticles.

The present invention is further directed to remediation of hearing loss. Hearing loss results from several causes. Damage to the ear sensory cells, or hair cells, of the cochlea is the leading cause of hearing loss. Congenital conditions and/or exposure to injurious levels of noise may also lead to hearing loss. Conventional hearing aid technologies amplify sound waves, but have provided only partial remediation. Further, certain individuals suffer such severe hearing loss that they are unable to benefit from traditional technologies.

Implantable hearing devices ("IHDs") have been developed to effectively address sensorineural hearing loss. However, the effectiveness of such devices is dependent upon proper alignment and positioning of the devices. Further, current IHD systems require surgical implantation. Thus, there remains a need for improved methods and systems to remediate hearing loss.

Figure 1:
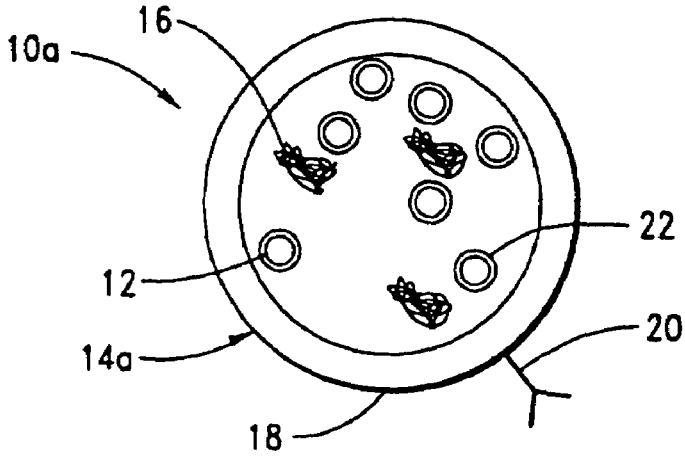
FIG. 1 is a diagrammatic representation of a nanosphere constructed in accordance with the present invention. The nanosphere has a plurality of nanoparticles and a therapeutic surrounded by a biocompatible shell.
Figure 2:
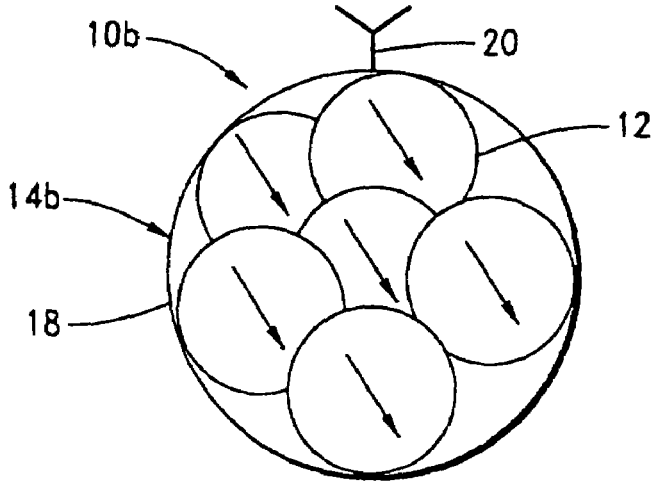
FIG. 2 is a diagrammatic representation of alternative embodiment of the nanosphere of FIG. 1. The nanosphere of FIG. 2 comprises a plurality of magnetically responsive nanoparticles encapsulated within a non-biodegradable silica shell. The nanoparticles are positioned so that they have uniformly aligned magnetic moments.
Figure 3:
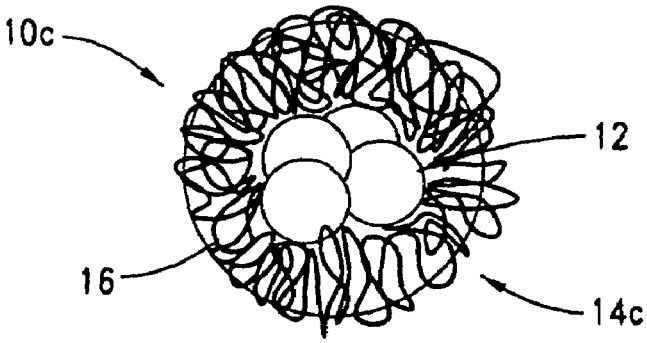
FIG. 3 is a diagrammatic representation of another alternative embodiment of a nanosphere shown in FIG. 1. The nanosphere in FIG. 3 comprises a plurality of nanoparticles surrounded by a biocompatible therapeutic.

Turning now to the drawings in general and FIGS. 1-3, in particular, there is shown therein a representation of a nanosphere 10*a-c* in accordance with the present invention. The nanosphere of FIG. 1 comprises at least a magnetically responsive nanoparticle 12 and a biocompatible shell or covering 14*a* encapsulating the nanoparticle. FIG. 1 illustrates the usefulness of nanospheres having magnetically responsive nanoparticles by demonstrating that a therapeutic 16 may be encapsulated within the biocompatible shell 14*a*. The combination of magnetically responsive nanoparticles 12 and therapeutics 16 encapsulated within a biocompatible shell 14*a* provides a system that may be delivered to a specific target within an organism using magnetic vectoring.

Continuing with FIG. 1, there is shown a nanosphere 10*a*, prepared using a method described herein. The nanosphere 10*a* of FIG. 1 comprises a plurality of magnetically responsive nanoparticles 12 in an erodable polymer matrix (not shown) and encapsulated within the biocompatible shell 14*a*. The nanosphere 10*a* of FIG. 1 contains the therapeutic 16, which is further encapsulated within the biocompatible shell 14*a*. The nanosphere 10*a* generally has a diameter of less than 300 nanometers, and more preferably a diameter of 100 nanometers or less.

The biocompatible shell 14*a* of nanosphere 10*a* may comprise materials, such as collagen, albumin, and polylactic acid, that are capable of being internalized by a cell. The biocompatible shell 14*a* encapsulates the nanoparticles 12 and forms a reservoir within which the therapeutic 16 may be contained. Other natural polymers, or synthetic bioerodable polymers, for example, polylactides or polyglycolides, or other similar materials known to those skilled in the art may also be used.

The biocompatible shell 14*a* may further comprise an outer surface 18 that has cell adhesion molecules 20 supported on the outer surface 18 of the biocompatible shell. The use of cell adhesion molecules allows the production of nanospheres that have a special affinity for a target cell. Thus, the cell adhesion molecule 20 may comprise a protein having an affinity for a predetermined type of cell. It will be appreciated that a wide array of cell adhesion molecules may be used with nanospheres of the present invention without departing from the spirit of the invention.

As shown in Table I, various adhesion molecules can be used to enhance cell endocytosis, that is, to facilitate engulfing of the drug encapsulated in the nanospheres 10*a* and 10*b* by the target cell.

TABLE I

| Adhesion Molecules | Target cells for adhesion |
|---|---|
| Collagen Type I | Epithelial cells |
| | Muscle cells |
| | Nerve cells |
| Collagen Type II | Chondrocytes |
| Collagen Type IV | Epithelial cells |
| | Endothelial cells |
| | Muscle cells |
| | Nerve cells |
| Superfibronectin | Epithelial cells |
| | Mesenchymal cells |
| | Neuronal cells |
| | Fibroblasts |
| | Neural crest cells |
| | Endothelial cells |
| Victronectin | Platelets |
| | Endothelial cells |
| | Melanoma cells |
| | Osteosarcoma |
| Selectins | Endothelial Cells |
| | Platelets |
| | Leucocytes |

Continuing with FIG. 1, the biocompatible shell 14*a* may encapsulate an erodable polymer matrix (not shown) that entraps the therapeutic 16 and releases it at a rate dependent upon the rate at which the matrix dissolves. It is preferable that the erodable polymer matrix is non-toxic and capable of being consumed, metabolized or expelled by the cell. An example of such an erodable polymer matrix is collagen, or any other suitable natural or synthetic polymer. In some instances with therapeutic delivery applications (discussed hereinafter), it may be desirable to form the nanosphere without the erodable polymer matrix, producing a nanosphere including a magnetically responsive nanoparticles 12 with a biofunctional component, or a therapeutic 16, as the encapsulating material. The physical properties of the therapeutic 16 have no relative effect on the functioning of the delivery system, because the delivery mechanism is externally controlled. The therapeutic 16 is delivered to the desired site, independent of its physical chemical properties, thus it can be water soluble or insoluble. Once internalized by the cell, the therapeutic 16 is exposed to the cellular components and consumed. The erodable polymer matrix serves to control the rate of release of therapeutic 16 from the nanosphere 10*a*. A tightly cross-linked matrix will exhibit a slow release rate providing low doses over longer periods of time. When no erodable matrix is present a rapid release of therapeutic 16 can be expected.

As previously discussed, nanosphere 10*a* of FIG. 1 comprises at least a magnetically responsive nanoparticle 12 having single-domain properties. However, it will be appreciated that nanosphere 10*a* may comprise a plurality of magnetically responsive nanoparticles 12. Preferably, the nanoparticles 12 are situated such that the single-domain magnetically responsive nanoparticles have uniformly aligned magnetic moments. The nanoparticles 12 may be comprised of a ferrite such as magnetite and have a silica or titania coating 22. Use of a such a coating 22 on the nanoparticle 12 renders the nanoparticle biocompatible.

Magnetite nanoparticles 12 are highly active ferromagnetic materials and are superparamagnetic, being magnetic when in a magnetic field and losing this property when the field is removed. The single-domain properties of the magnetite nanoparticles 12 of the present invention, when in a magnetic field, will only be attracted to the strongest side of the field gradient and will not be attracted by other or similar nanoparticles. Thus, particle to particle interactions resulting in clumping or other undesirable effects are minimized. Once the magnetic field is removed, the nanoparticles 12 lose their magnetic remanence.

Turning now to FIG. 2, there is shown therein an alternative nanosphere 10*b* having a biocompatible covering 14*b* comprising a non-biodegradable coating that makes the biocompatible shell non-erodable. Nanosphere 10*b* is shown to contain a plurality of nanoparticles 12 within the biocompatible covering 14*b*. The nanoparticles 12 are arranged so that the magnetic moments of each are aligned with the other nanoparticles. The biocompatible covering 14*b* may have any one of the previously discussed cell adhesion molecules 20. The use of nanospheres 10*b* comprising a non-biodegradable shell 14*b* promotes sustained residence of the nanoparticles 12 within targeted cells as discussed hereinafter.

Turning now to FIG. 3, there is shown therein a nanosphere 10*c* comprising a plurality of single-domain nanoparticles 12 encapsulated by a biocompatible shell 14*c*. However, the nanosphere 10*c* of the FIG. 3 is formed so that the therapeutic 16 to be delivered to the cell form the biocompatible shell 14*c*. The therapeutic 16 may be coupled or physically attached to the nanoparticles 12 by chemical means that will be apparent to one skilled in the art. In some instances, for example, as in an application for chemotherapeutic delivery, linkage of the therapeutic 16 to the nanoparticle 12 surface may be necessary to "drag" the therapeutic magnetically to the site. Such a linkage may be created by adding such compounds as linkers or functional groups to the silica surface 22 of the nanoparticle 12 so that the surface coating comprises "hooks" (not shown) by which the therapeutic 16 may be linked to the nanoparticles. "Hooks" is to be understood as a generic term to denote a physical attribute, affinity site, functional moiety or mechanism by which the therapeutic 16 may be linked. The hooks can be, for example, physical locations at which the therapeutic may be physically or chemically attached.

Figure 4:
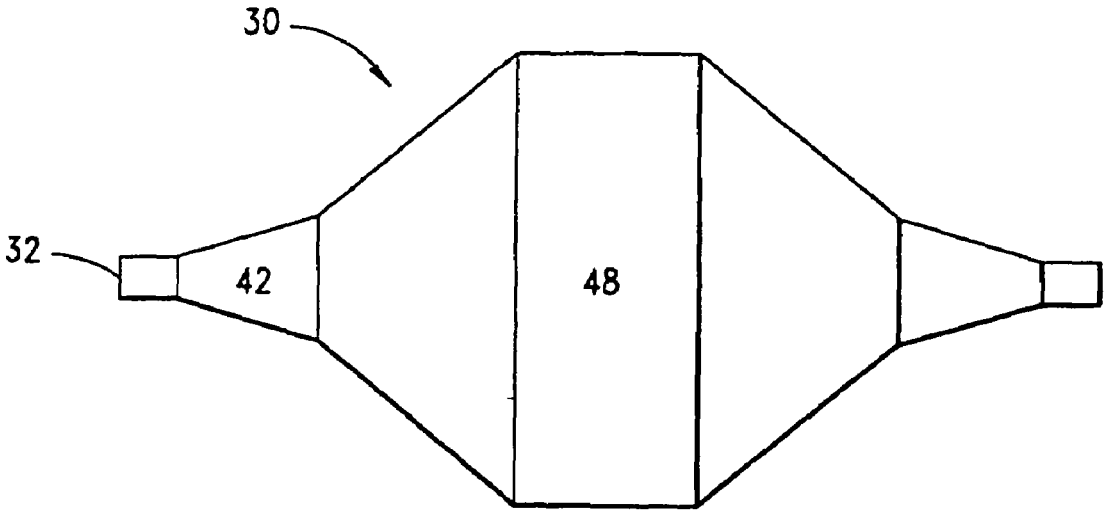
FIG. 4 is a diagrammatic representation of a gas phase synthesis system for producing magnetically responsive nanospheres using a radio-frequency-inductive plasma ("rf-IP") torch.

Turning to FIG. 4, there is shown therein a system for preparing magnetically responsive nanospheres 10*a-c* having magnetically responsive nanoparticles 12 and biocompatible shells 14*a-c*. The magnetically responsive nanoparticle 12 (FIGS. 1-3) is prepared by a plasma synthesis process comprises vaporizing a magnetic metal salt, oxidizing the vaporized magnetic metal salt, and quenching an oxidized metal vapor produced in the oxidizing step.

FIG. 4 shows a diagrammatic representation of a rf-IP synthesis system, based on an electrodeless system, to prepare magnetically responsive nanoparticles 12. The magnetic metal salt is heated so that the magnetic metal salt is vaporized. As an effective heat source, plasmas can generate temperatures above 10,000° K, far above the melting temperatures of known materials. It is to be understood, that other heat sources known to those skilled in the art, such as, for example, gas burners, may be used. However, rf-IP allows a relatively large volume throughput versus low velocity plasma gas over range of reactor conditions of pressure and temperature. As a result, nanoparticle size and distribution can be precisely controlled.

Figure 5:
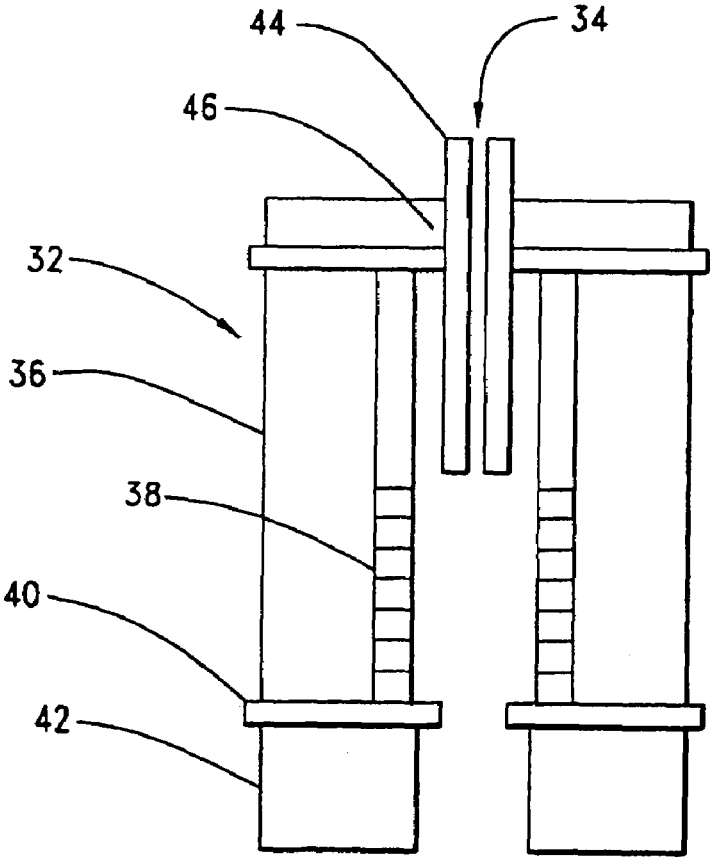
FIG. 5 is a diagrammatic representation of an rf-IP torch used in a process to make nanoparticles in accordance with the present invention.
Figure 3:
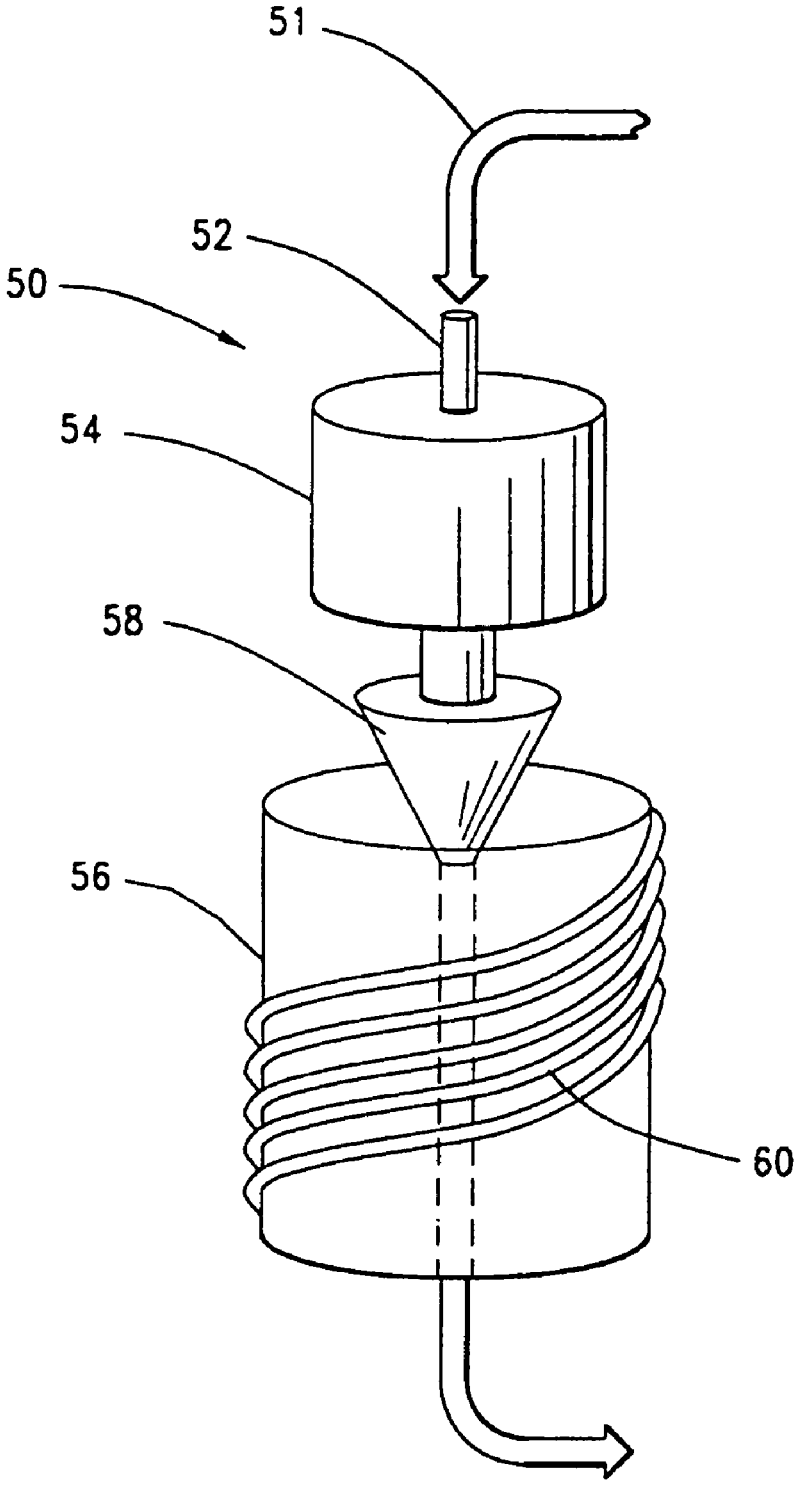

Once the magnetic metal salt is vaporized it may be oxidized. The preferred plasma synthesis process for making magnetite-based nanoparticles involves the vaporization and injection of the magnetic metal salt in the presence of oxygen in the rf-IP torch 32 from direction 34. As shown in FIG. 5, the rf-IP torch 32 may comprise a ceramic shell 36 and an induction coil 38. The base 40 of the plasma torch 32 is connected to a reactor 42. The magnetic metal salt may comprise ferric and ferrous mixture having a ratio between 2 to 1 and 10 to 1. The magnetic metal salt may further comprise a ferric salt or ferric/ferrous salt combination (3:1), for example chloride.

Referring now to FIG. 5, the magnetic metal salt mixture may be injected into the plasma reactor 32 via an opening 44. The magnetic metal salt is vaporized in the presence of oxygen, which is injected into the torch via a gas inlet 46. The vaporized magnetic metal salt feed may be axially injected into the center of the plasma discharge 47, or it could be injected in the radial direction into the plasma discharge 47 at the exit of the torch, or a combination of the two modes of injection could be used. Subsequent to the injection, the vaporized magnetic metal salt feed reacts with oxygen in the plasma where oxidation of the magnetic metal salt occurs to produce an oxidized metal vapor. The following oxidation reaction proceeds rapidly to yield the formation of, for example, $Fe_3O_4$ vapors and free chlorine:

$$6FeCl_3+2O_2 \rightarrow 2Fe_3O_4+9Cl_2.$$

Salts, such as, for example, $Li^+$ may be additionally injected in the reactor to create surface charges to reduce collisions and minimize particle agglomeration. Additionally, if desired, the nanoparticles 12 may be treated with a biocompatible surface agent. Surface treatment agents such as silicon tetrachloride or titanium tetrachloride can be introduced immediately downstream in the reactor to cause the ferrite nanoparticles to have Si or Ti coatings respectively. The silicon tetrachloride or titanium tetrachloride may be injected simultaneously with the magnetic metal salt into the reaction gas stream in the rf-IP torch chamber via an optional inlet, or downstream from reaction gas stream, or a combination of simultaneously with and downstream from the reaction gas stream. The formed vapors in the chamber co-condense giving rise to a spherical shell possessing a magnetically responsive nanoparticle with a surface layer of titania or silica, and therefore, result in formation of nanoparticles that are biocompatible.

It is to be understood that titanium tetrachloride and silicon tetrachloride are only representative examples of materials used for biocompatibility and coating. Rather, other materials used for biocompatibility will be apparent to one skilled in the art. Further, suitable organic monomers and polymers may also be used to coat the magnetically responsive nanoparticles.

Returning to FIG. 4, the oxidized metal vapor that has formed in the reactor 42 is subjected to controlled quenching by passing the reactor stream into a quench chamber 48. In the quench chamber 48, rapid gas expansion occurs concurrently with the injection of an inert cooling gases to yield nanoparticles of uniform size and size distribution. Quenching of the nanoparticles may be achieved by injection of a compressed gas, for example air, that creates a quench zone which rapidly reduces the temperature of the particles, thus effectively terminating particle growth to yield uniform particle size and size distribution. Controlled quenching enables formation of a relatively narrow particle size distribution centered around a target mean particle diameter of, for example, less than 30 nanometers, preferably less than 10 nanometers. The nanoparticles may then be collected using an electrostatic filter or similar type system known to those skilled in the art.

In another exemplary embodiment, magnetically responsive nanospheres having a single-domain nanoparticle and biocompatible shell can be prepared by a generally aqueous process. Generally known methods for aqueous synthesis may be modified to prepare the nanoparticles for the purpose of this invention. For example, the method disclosed in Massart (IEEE Transactions on Magnetics, col. Mag-17, No. 2, 1247 March 1981, the contents of which are incorporated herein by reference) may be used to prepare nanoparticles. In accordance with the present invention, single-domain magnetically responsive nanoparticles are prepared by a process comprising preparing a solution of magnetic metal salts and alkaline media to form a precipitate. The precipitate is then washed with a solvent like acetone and collected with a magnetic field. The precipitate is washed again with the solvent and dried.

The mixture of magnetic metal salts may comprise an aqueous mixture of ferric chloride and ferrous chlorides in a ratio of between 2 to 1 and 10 to 1, which is added to the aqueous alkaline media. The alkaline media may comprise ammonium hydroxide. The combination of the magnetic metal salt mixture and the alkaline media results in a gelatinous precipitate that may be isolated from the solution by centrifugation or magnetic decantation without washing with water. The gelatinous precipitate may be peptized with, for example, Tetramethyl-ammonium hydroxide to form a stable alkaline magnetic solution or nanodispersion. Solutions of this type are stable for long periods of time. Acidic solutions can also be produced.

The resulting nanoparticles 12 can be collected from stable nanodispersion through the controlled reduction of pH to below 10.5 or less. At this point the nanoparticles 12 can be magnetically extracted and collected. The particles are easily dispersed again in aqueous media with sonication.

Because further processing of the nanoparticles to form nanospheres may be desired or required, it is not necessary to dry the nanoparticles at this stage, due to aggregation and agglomeration phenomena which may yield undesirable size distributions, and subsequent inefficient and ineffective performance properties. However, if the formation of nanospheres is desired, the nanoparticles may be either air dried or air dried and then oven dried.

If surface treatment of the nanoparticles is required, the precipitate may be surface treated with sodium silicate or chloride salts. At a high pH, a surfactant may be added and followed by the introduction of the coating material. As the pH is slowly reduced, the magnetic nanoparticles are coated with the silica.

Turning to FIG. 6, there is shown therein, a system 50 for the preparation and production of magnetically responsive nanospheres having a biocompatible shell. A feed stock comprising at least a magnetically responsive nanoparticle and a sodium silicate is prepared and atomized using the spray dryer system 50. It will be appreciated that the polymer and therapeutic may be added to the feed stock so that the resulting nanosphere contains a therapeutic. The nanodispersion feed stock 51 is introduced into the system 50 through a fluid inlet 52 and into a reservoir 54. The feed stock 51 is contained within the reservoir 54 until it is injected into a heated drying chamber 56 through a pressure spray nozzle 58. The spray nozzle 58 produces an aerosol distribution through ultrasonic liquid atomization. Evaporation of the solvent, diffusion of solute, and drying of the nanoparticle, all occur inside the drying chamber 56 to form the nanospheres 10*a*, 10*b*, and 10*c*.

The composition of the nanosphere is determined by the solute or reactant concentrations in the starting nanodispersion solution, which is prepared in predetermined stoichiometric ratios. Water or alcohol may be used as a solvent, either separately or in combination. The colloidal suspension, which contains liquid and solid particles, is atomized into the drying chamber 56 and the liquid phase (the solvent) evaporates from the droplets.

The average size and size distribution of the final nanospheres may be roughly determined from the size of the atomized droplet and the initial concentration of the starting nanodispersion. The nanodispersion is forced out of the spray nozzle 58 by a compressed gas, for example, nitrogen. Atomization is the production of droplets and their dispersion into the gas, and the apparatus used to produce such droplets is known as an atomizer (not shown). The size or morphology of the final particles produced can also be determined by the concentration and velocity of the droplet generated by the atomizers. A variety of atomization methods may be used, such as air-assist (pneumatic) or a two-fluids nozzle, ultrasonic, vibrating orifice and spinning disk.

Various modifications of operating conditions in the spray dryer system 50 will lead to an efficient production of nanospheres of a desired particle size. Such modifications may include, for example, use of one or more atomizer nozzles, controlling the pressure at which the feed nanodispersion is pumped through the nozzle 58, and the feed to air ratio. Operating conditions, for example, the dispersion concentration, feed rate, nozzle concentration, gas pressure, and feed flow rate are specified to produce an aerosol distribution such that on drying, the resultant nanosphere will have a particle diameter of 100 nanometers or less.

The drying chamber 56 may optionally contain an electromagnetic coil 60 capable of generating a static or an oscillating magnetic field. As the atomized droplets pass through this applied magnetic field, the nanoparticles within the droplets are forced to align so that their magnetic moments are uniformly aligned. An operating value range for the magnitude of the magnetic field to be effective in causing the nanoparticles to be aligned may depend on, for example, the size of the nanoparticles or the size of the resultant nanosphere, and may be, in the range of 0.05 T to 10 T. The alignment of the nanoparticles in the magnetic field during the drying process results in the production of magnetically responsive nanospheres having increased susceptibility. It will be appreciated, however, that the electromagnetic coil 60 may be aligned so that it is perpendicular to the direction of flow of nanoparticles exiting the nozzle 58 to provide enhanced alignment of the nanoparticles. Nanospheres with increased magnetic susceptibility will be easier to manipulate and vector in applications, responding more effectively in the magnetic field, which in turn may assist with site-specific positioning and internalization of the nanospheres.

It will be appreciated that cell adhesion molecules may be added to the surface of the biocompatible outer shell by redispersing the nanospheres in a solution containing the desired adhesion molecule. The solution may be aqueous, organic or a mixture of both. The above spray drying process is repeated using the spray drying system 50. This second spray drying provides a nanosphere having a biocompatible outer shell that has adhesion molecules showing an affinity for certain target cells.

In accordance with the present invention, there is provided a method for targeted delivery of nanospheres 10 to a desired site in a body. The method comprises using a three dimensional magnetic field to guide at least a nanosphere to the desired site within the body. It will be appreciated that a plurality of nanospheres may be used without departing from the spirit of the present invention.

The nanosphere 10 is introduced into the body by, for example, application of a paste containing the magnetically responsive nanosphere to the requisite body part to be treated. More specifically, where an organ to be treated is easily accessible, for example, an ear, the paste may be applied by any generally known method, for example, by a brush-type applicator. In the event that the organ to be treated is not readily accessible, the nanosphere 10 may be introduced close to the site with the use of other generally applicable methods, for example, a catheter.

The magnetically responsive nanospheres are guided toward the target site by the application of a controllable magnetic field adapted to move the nanospheres in three dimensions. At the desired site, the nanospheres may be internalized by the target cells. The three-dimensional magnetic field is created externally by, for example, an electromagnetic unit similar to the type used in rf-cardiac ablation surgery, of which the Stereotaxis Interventional Workstation is a known example.

In rf-catheter ablation surgery, utilization of an electromagnetic, three-dimensional, catheter Interventional Workstation aids the cardiac electrophysiologist in placing the recording/lesioning catheter. This technology integrates a super-cooled electromagnet which generates magnetic fields of about 0.2 Tesla to guide the tip of the ablation catheter to the target site in the heart, for example, to the right atrial appendage of the heart. The three dimensional magnetic field permits the catheter to enter and place its tip on difficult anatomical sites. However, because this unit creates a uniform magnetic filed, it is necessary to create a gradient in the field in which nanospheres can be vectored towards the desired site. Once at the site, the nanospheres are held in place until internalized by cells has occurred. Internalization can generally be expected to occur within as much as a few hours or as little as a few minutes.

In yet another example, consistent with the embodiments of the present invention, the magnetically responsive nanospheres 10 may be used to treat urological diseases. In the event that there is a bacteria buildup, it becomes necessary to deliver drugs, such as antibiotics, to the infected region. However, traditional methods are not extremely effective due to the difficulty associated with the penetration of the antibiotics through the cell walls to the infected site. This is especially true in treatment of bacterial diseases that occur in human females. The magnetically responsive nanospheres overcome this difficulty due to the ease with which they are endocytosed and the ability to enhance internalization magnetically. Hence, therapeutic antibiotics transported with the nanosphere 10 may be delivered site-specifically. Cell internalization is facilitated by the use of a magnetic force, which is used to pull the nanoparticles through the cellular wall to the infection site. Additionally, adhesion molecules may be used, as previously discussed, with the nanospheres to aid the process of endocytosis. The therapeutics may be delivered by, for example, a catheter or introduced through an injection at or near the infection site.

Consistent with the embodiments of the present invention, the nanospheres are targeted toward a target site based on gradients created in the magnetic field. The nanospheres, having superparamagnetic nanoparticles, when in a magnetic field are attracted to the strongest side of the gradient and will not be attracted to other or similar particles. Once the magnetic field is removed, the nanoparticles lose their magnetic properties, exhibiting little remanence.

In addition, or in the alternative, an external magnetic field from, for example, a permanent magnet positioned at an opposing end from where the nanoparticles are introduced towards the cell, may be used to provide an external force to facilitate internalization into cells by drawing the nanoparticles into the cellular layer.

Once the nanospheres 10 have transported the therapeutic 16 to the desired site, the magnetic field may remain for a suitable length of time to allow the therapeutic to be internalized into the cells by the magnetic force. Residence time of the magnetic field depends on several molecules, such as particle size and the applied external magnetic force.

It will be appreciated that the targeted therapeutic delivery system described herein can be used to deliver site-specifically a wide range of therapeutics including, but not limited to, chemotherapeutics for targeted cancer therapies, therapeutics for the treatment of gastric disorders such as Gastro-Intestinal-Reflux-Disease, and for therapeutics having a wide range of solubility properties—soluble versus insoluble, thus, improving the effectiveness of the therapeutics while minimizing side effects.

The nanosphere 10*b* of FIG. 2 may be magnetically vectored to a site so that the nanosphere may be incorporated into the cell structure of an organ for long-term assistance in organ functioning. In cases where mechanical function of an organ has failed or is diminished, magnetically responsive nanosphere 10*b* can be used in a corrective or remedial sense. Such nanospheres 10*b* may be used for various applications, such as, but not limited to, sphincter muscle opening and closing, blinking of an eye, tissue repair/reattachment, bladder control, ear vibration for sound amplification, and diagnostics such as imaging. The capacity to use magnetic organ assisting nanospheres 10*b* to assist in wound healing and tissue repair may improve healing rates and recovery times. Examples of such applications include connecting and holding torn ligaments and muscles during and after surgery; and controlling or stimulating involuntary muscle movements such as eye blinking. An exemplary embodiment may be a nanosphere having at least a magnetically responsive nanoparticle that is effective as a component of an implantable hearing device ("IHD").

Figure 7:
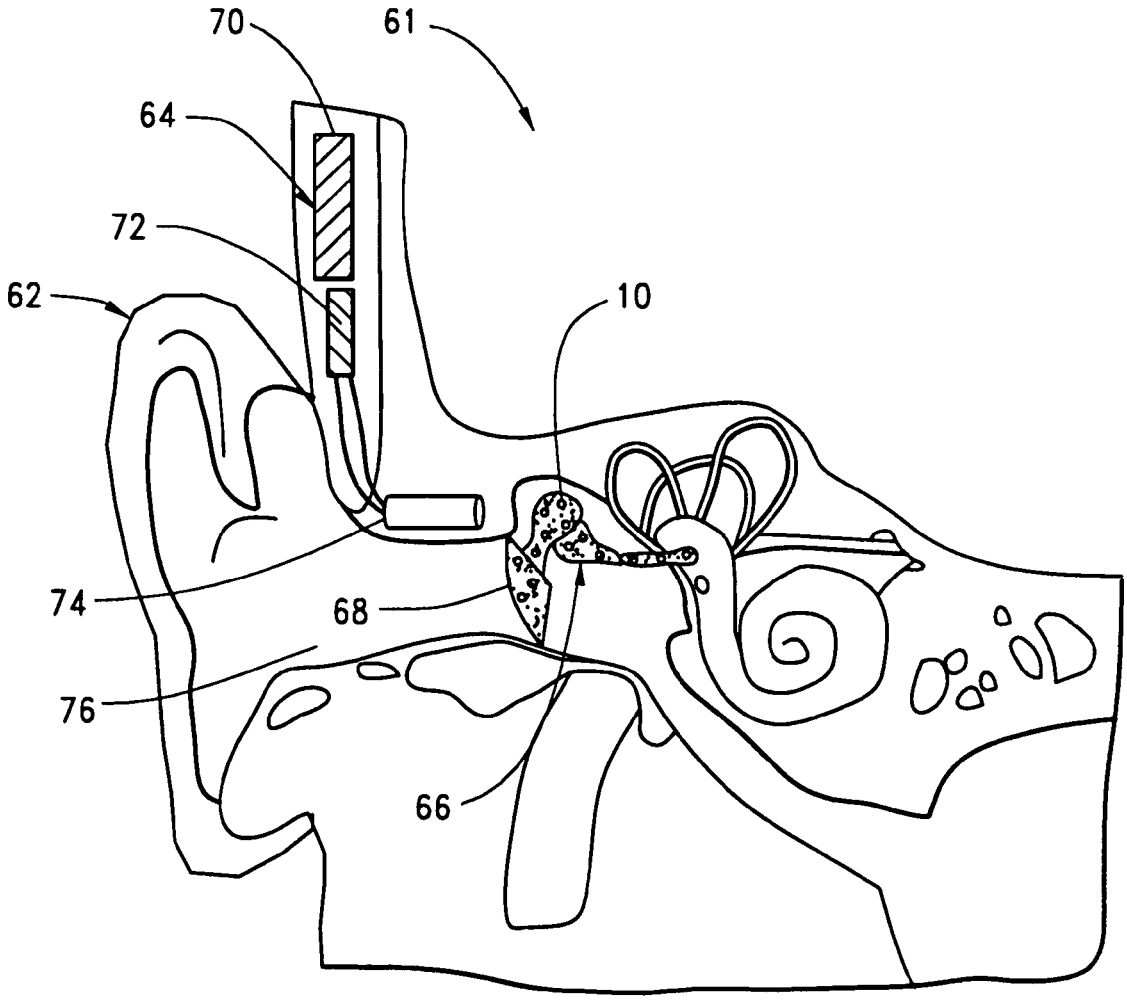
FIG. 7 is a diagrammatic, partially enlarged, representation of a system for affecting a function of the ear of a mammal. The ear shown in FIG. 7 is a stereotypical human ear having magnetically responsive nanoparticles supported thereon. The system of FIG. 7 illustrates the use of a transmitter assembly to cause movement of the nanoparticles. The nanoparticles are shown supported on the ossicular chain of the ear. The transmitter assembly is shown having an electromagnetic coil that drives movement of the nanoparticles through transmission of an electromagnetic field.

Turning now to FIG. 7, there is shown therein a system 61 for affecting a function of a mammal. The system 61 of FIG. 7 is adapted to provide remediation of hearing loss in mammal specimens. For purposes of illustration the system 61 is shown affecting the ear 62 of a human. The system 61 may comprise the previously described nanosphere 10*b* of FIG. 2 and a transmitter assembly 64. The nanosphere 10 is shown supported on the ossicular chain 66 of the middle ear and comprises at least one of the single-domain nanoparticles 12 described herein. Additionally, the nanospheres 10 are shown supported within the cells (not shown) of the tympanic membrane 68. It will be appreciated that the nanospheres 10 may be supported on either the tympanic membrane 68 or the ossicular chain 66, or both.

The transmitter assembly 64 may comprise a receiver assembly 70 supported by the ear 62, a processor 72 and an electromagnetic coil 74. The receiver assembly 70 is adapted to detect a sound wave and to transmit the detected sound wave. The receiver assembly 70 may comprise a subcutaneous microphone that is capable of collecting sound waves. The processor 72 receives the detected sound waves from the receiver assembly 70 and processes the detected sound waves. Processing of the sound waves results in an output signal that is transmitted to the electromagnetic coil 74. The electromagnetic coil 74 is adapted to transmit an electromagnetic signal in response to the output signal from the processor 72 that is indicative of the sound waves received by the receiver assembly 70. Alternatively, the transmitter assembly 64 may comprise any known sound processor supported in the ear canal 76 that is capable of producing a magnetic field. One such system is described in U.S. Pat. No. 6,277,148, the contents of which are incorporated herein by reference. It will be appreciated, however, that the present invention does not require the transmitter assembly 64 to be supported on the human. Rather, the transmitter assembly 64 may be supported at a location remote from the human so that the output signal may be simultaneously broadcast to several individuals.

The output of electromagnetic coil 74 is an oscillating, alternating electromagnetic field representing sound that causes vibration of the nanospheres 10 and/or the nanoparticles 12. The magnetic field produced by the electromagnetic coil 74 may transmit a signal having a frequency of about 1000 Hz. Vibration of the nanospheres and/or nanoparticles causes the ossicular chain to similarly vibrate, thus providing clear, full-fidelity sound cochlea of the inner ear. It will be appreciated that the magnetic field transmitted by the electromagnetic coil 74 comprises an oscillation cycle. It will be further appreciated, due to the superparamagnetic qualities of the nanoparticles 12, that the nanoparticles may be moved at least twice during the oscillation cycle. Doubling the movement of the nanoparticle 12 will provide doubling of the frequency of the amplified sound waves detected by the receiver assembly 70. For example, transmission of a 1000 Hz signal will result in vibration of the nanoparticles and thus the ossicular chain at 2000 Hz.

The present invention further includes a method for affecting a function of a mammal's ear. The method comprises supporting at least a single-domain magnetically responsive nanoparticle 12 in the ear 62 of the mammal. A magnetic field is transmitted to drive movement of the nanoparticle 12. The magnetic field is generated using a magnetic field transmitting assembly 64 that is supported within the ear 62 of the mammal. A plurality of nanoparticles 12 may be supported within a nanosphere 10*b* so that a greater response to the magnetic field is generated. In accordance with the present invention, the method may further comprise moving the nanoparticles 12 into an epithelial cell (not shown) of the ear 62 using a controllable magnetic field. The method may further comprise receiving a sound wave and converting the sound wave into the transmitted magnetic field.

In another application of the present invention, there are provided nanoparticles that are surface treated to render them useful as imaging tools. These surface treated nanoparticles may be prepared by any process or method discussed herein. The magnetically responsive nanoparticles may be surface treated with, for example, gold, gadolinium or titanium. Such surface treated nanoparticles may be vectored to a desired site with an external three dimensional magnetic field. The surface treated nanoparticles may provide a localized enhanced image. For example, gadolinium is a specific contrast agent used for detecting and highlighting neoplasia/inflammatory tissue for MRI evaluation, it is routinely utilized in most scan procedures. However, getting gadolinium to the site for accurate imaging has faced some difficulties that could be resolved through the use of controlled 3-D movement of the nanoparticles as discussed above.

The invention will now be described in more detail with reference to the following Examples which merely serve to illustrate the invention, not to restrict or limit it in any way.

EXAMPLE 1

An aqueous solution of Ferric Chloride ($FeCl_3$) was mixed with an acidic solution of Ferrous Chloride ($Fe_2Cl_3$) in a molar ration of 2:1 to 10:1, and heated to 75° C.-100° C. under an $N_2$ blanket, with gentle stirring, and held at that temperature for approximately 15-30 minutes. The Fe mixture was added to aqueous ammonia to form a magnetic-solution precipitate. The mixture was then stirred for 30 minutes under an $N_2$ blanket and the precipitate collected using a magnetic field. The precipitate was washed several times in distilled water to remove salt products produced by the reaction. The precipitate was collected using a magnetic field and dispersed in acetone, collected and dried two more times. The magnetically responsive nanoparticles produced by the above process had a magnetic susceptibility of greater than 35-40 emu/g and an average diameter of less than 50 nanometers.

EXAMPLE 2

The procedure according to Example 1 was followed to produce a known weight of nanoparticles. The nanoparticles were then dispersed in aqueous ammonia at pH>11 to form a stable ferrofluid. A known weight of sodium silicate was added to aqueous ammonia to give a desired molar ratio of Si:Fe between 0.5 and 10, and added to the prepared ferrofluid under a $N_2$ blanket and allowed to stir for 15 minutes. The pH was adjusted to 10.5 with HCl and the mixture was stirred an additional 2 hours. The pH was again adjusted to 9.0, and the mixture was stirred for 2 more hours.

To ensure complete silica coating of the nanoparticles, the pH was raised to 10.5 with stirring for 2 hours and then lowered to pH 9.0 with HCl. The product was collected using a magnetic field and washed in distilled water and acetone. The product was then collected and dried. The silica coated magnetically responsive nanoparticles produced in this manner had a magnetic susceptibility greater than 20 emu/g while having an average diameter of less than 50 nanometers. The silica coated nanoparticles had a composition ratio of 0.5:1 to 5:1 Si to Fe.

EXAMPLE 3

A known weight of the silica coated nanoparticles produced in Example 2 were dispersed at room temperature in a small amount of distilled water to form a thick gelatinous mass. An amino-silane, such as 3-aminopropyltrimethoxysilane, was added to the aqueous mixture with stirring, and allowed to react under an $N_2$ blanket for 30 minutes. The product was recovered using a magnetic field and washed several times in distilled water. The product was taken up in distilled water and the pH was lowered the pH to 6.5 with HCl. The product was collected magnetically, washed in distilled water and dispersed and collected from acetone. The presence of the amine functionality was confirmed using the Kiaser test.

EXAMPLE 4

Magnetically responsive nanoparticles 12 were used to facilitate the vibration of the middle ear structure in an animal model. The middle ear structure comprised a malleus, an incus, and a stapes. The lateral surface of the incus was coated with a suspension of nanoparticles 12 by placing 100 microliters of the nanoparticle suspension in physiological saline (pH of about 7.4) onto the lateral surface of the incus. At 8 and 15 days post-implantation, the animals were euthanized and taken to a laser Doppler interferometry laboratory. An electromagnetic coil 7 mm in length, 2 mm in diameter was placed 2-3 mm from the incus and activated with sinusoidal voltage of 8-11 volts, at 1000 Hz. A reflective laser target 1×1 mm was placed on the incus, which was in tact with the malleus and stapes.

The external magnetic field vibrated the incus at 2000 Hz (due to the superparamagnetic property of the nanoparticles 12). The amplitude of vibration was approximately 5 nm. In two other animals these same nanoparticles 12 were placed on the tympanic membrane "TM" and an external magnetic field used to facilitate internalization of the nanoparticles into the epithelium. When the same electromagnetic coil was placed 2-3 mm from the TM and activated at 1000 Hz, 11 volts, it vibrated at 2000 Hz with displacement amplitude of approximately 16.5 nm. Thus, nanoparticles generated forces in the middle ear, thereby, aiding hearing amplification.

Various modifications can be made in the design and operation of the present invention without departing from the spirit thereof. Thus, while the principal preferred construction and modes of operation of the invention have been explained in what is now considered to represent its best embodiments, which have been illustrated and described, it should be understood that within the scope of the appended claims, the invention may be practiced otherwise than as specifically illustrated and described.

What is claimed is:

1. A method for affecting a function of a mammalian ear, the method comprising:

moving at least a single-domain magnetically responsive nanoparticle into a cell of the ear using a controllable first magnetic field;

supporting the nanoparticle in the ear of the mammal; and transmitting a second magnetic field to move the nanoparticle.

2. The method of claim 1 further comprising supporting a magnetic signal transmitter within the ear of the mammal.

3. The method of claim 1 wherein the ear comprises an ossicular chain, the method further comprising supporting the nanoparticle on the ossicular chain.

4. The method of claim 1 wherein the first magnetic field comprises a gradient.

5. The method of claim 1 wherein the second magnetic field comprises an oscillation cycle, the method comprising moving the cell and the nanoparticle at least twice during the oscillation cycle.

6. The method of claim 1 wherein the method further comprises:

receiving a sound wave; and converting the sound wave into the second magnetic field.

7. A method for affecting function of a mammalian ear, the method comprising:

moving a magnetically responsive nanosphere into a cell of the mammalian ear using a controllable first magnetic field;

supporting the magnetically responsive nanosphere in a moveable manner within the mammalian ear; and transmitting a second magnetic field to move the nanosphere.

8. The method of claim 7 wherein the second magnetic field comprises an oscillation cycle, the method comprising moving the nanoparticle at least twice during oscillation cycle.

9. The method of claim 7 wherein the method further comprises:

receiving a sound wave; and converting the sound wave into the second magnetic field.

10. The method of claim 7 wherein the nanosphere comprises a single-domain nanoparticle.

11. The method of claim 10 wherein the second magnetic field comprises an oscillation cycle, the method comprising moving the nanoparticle at least twice during the oscillation cycle to move the nanosphere.

* * * * *

UNITED STATES PATENT AND TRADEMARK OFFICE

CERTIFICATE OF CORRECTION

PATENT NO. : 7,344,491 B1
APPLICATION NO. : 10/965056
DATED : March 18, 2008
INVENTOR(S) : Charles E. Seeney and Kenneth J. Dormer It is certified that error appears in the above-identified patent and that said Letters Patent is hereby corrected as shown below:

Title page, item [73] "Assignee: after "Nanobiomagnetics, Inc., Edmond, OK (US)" add -- Board of Regents of the University of Oklahoma, Norman, OK (US) --

Signed and Sealed this
First Day of March, 2011

David J. Kappos

David J. Kappos
*Director of the United States Patent and Trademark Office*